US008978916B2

(12) United States Patent
Byeon

(10) Patent No.: US 8,978,916 B2
(45) Date of Patent: Mar. 17, 2015

(54) MULTI-FUNCTIONAL WASTE CAN

(71) Applicant: Go Eun Byeon, Seoul (KR)

(72) Inventor: Go Eun Byeon, Seoul (KR)

( * ) Notice: Subject to any disclaimer, the term of this patent is extended or adjusted under 35 U.S.C. 154(b) by 0 days.

(21) Appl. No.: 14/352,660

(22) PCT Filed: Oct. 19, 2012

(86) PCT No.: PCT/KR2012/008633
§ 371 (c)(1),
(2) Date: Apr. 17, 2014

(87) PCT Pub. No.: WO2013/058619
PCT Pub. Date: Apr. 25, 2013

(65) Prior Publication Data

US 2014/0246438 A1 Sep. 4, 2014

(30) Foreign Application Priority Data

Oct. 20, 2011 (KR) ..... 10-2011-0107517

(51) Int. Cl.
*B65F 1/06* (2006.01)
*B65F 1/14* (2006.01)

(52) U.S. Cl.
CPC ..... *B65F 1/062* (2013.01); *B65F 1/1405* (2013.01); *B65F 1/163* (2013.01); *B65F 1/1646* (2013.01); *B65F 1/1426* (2013.01)
USPC ..... 220/262

(58) Field of Classification Search
CPC ..... B65F 1/163
USPC ..... 220/262, 495.08, 495.05, 23.86, 23.87, 220/23.9
See application file for complete search history.

(56) References Cited

U.S. PATENT DOCUMENTS

| | | | | |
|---|---|---|---|---|
| 776,965 | A * | 12/1904 | Thomas | 220/262 |
| 5,322,179 | A * | 6/1994 | Ting | 220/495.07 |
| 6,837,393 | B1 * | 1/2005 | Kuo | 220/263 |
| 8,136,688 | B2 * | 3/2012 | Lee et al. | 220/262 |
| 2006/0175336 | A1 * | 8/2006 | Wang | 220/495.04 |
| 2006/0278643 | A1 * | 12/2006 | Chiou | 220/263 |
| 2007/0295722 | A1 * | 12/2007 | Titas et al. | 220/23.83 |

* cited by examiner

*Primary Examiner* — Steven A. Reynolds
*Assistant Examiner* — King M Chu
(74) *Attorney, Agent, or Firm* — IM IP Law PLLC; C. Andrew IM

(57) ABSTRACT

A multi-functional waste can has a dual function. A lid is openable at both sides like a seesaw or openable while being lifted upwardly by a foot lever. It has a rotating hinge to connect a main body, the lid and the foot lever forms a single unit to compress wastes using the lid. An auxiliary can be detachably arranged in the waste can so that wastes with offensive odor can be sealed in a disposable bag. The rotating hinge of the multi-functional waste can is rotatably connected to an upper portion of the waste can via a hinge pin, the foot lever is connected to the rotating hinge via a push rod, and a pair of seesaw shafts disposed on the upper portion is arranged at the lid. One of the seesaw shaft is connected collinearly with the central axis of the rotating hinge.

9 Claims, 12 Drawing Sheets

MULTI-FUNCTIONAL WASTE CAN

RELATED APPLICATIONS

This application is a §371 application from PCT/KR2012/008633 filed Oct. 19, 2012, which claims priority from Korean Patent Application No. 10-2011-0107517 filed Oct. 20, 2011, each of which is herein incorporated by reference in its entirety.

TECHNICAL FIELD

The present invention relates to a multi-functional waste can, and more particularly, to a multi-functional waste can in which a lid of a garbage can is openable at both sides thereof like a seesaw or is openable while being lifted upwardly by a foot lever, and which has a rotating hinge to connect a main body, the lid and the foot lever into a single unit so that the lid can be used as a tool for compressing wastes, thus achieving a simple configuration in that the rotating hinge serves as a central shaft and as a lever for the lid. More particularly, the present invention relates to a multi-functional waste can in which an auxiliary can is detachably arranged in the waste can so that wastes with offensive odor can be sealed in a disposable bag.

BACKGROUND ART

In general, waste cans are mainly used at home. Recently, because people in Korea have to buy and use volume-rate garbage bags when they throw away wastes, they throw away the wastes in the volume-rate garbage bag after compressing the wastes using their hands and feet in order to put the wastes into the garbage bag as many as possible and tying up the garbage bag. In consideration of the circumstance, Korean Utility Model Registration No. 308,577 discloses a waste can capable of compressing and putting in wastes.

In Korean Utility Model Registration No. 308,577, the waste can includes a pressure bar disposed at an upper portion of a lid and a compression plate disposed on the inner face of the lid in order to compress wastes when a user presses the pressure bar. When the user steps a foot lever, because the lid is lifted up, the user can throw away wastes conveniently.

However, such a conventional waste can has disadvantages in that it is complicated in structure because it includes the compression plate, the pressure bar and a spring as well as the lid, and in that it is inconvenient to wash the waste can because the lid is not separated from the waste can.

Korean Utility Model Registration No. 427,742 discloses a structure that a lid is rotated to compress wastes, but such a conventional invention also has a disadvantage in that it is inconvenient in use because the user directly opens the lid in order to throw away wastes.

Korean Utility Model Registration No. 252,552 discloses a waste can having a lid which is rotatable like a seesaw. The conventional invention is convenient in throwing away wastes because the lid is opened while rotating like a seesaw and the lid can be used as a compression plate because the lid is separable from the waste can. However, the conventional invention has several disadvantages in that it is complicated in structure because the lid is combined to the waste can by retaining protrusions and springs which serve as seesaw shafts, and in that there is a technical limit that the lid must be separated from the waste can to use the waste can because an opening degree of the lid is restricted due to the wastes contained in the waste can when the lid is rotated like a seesaw.

Korean Patent No. 1,040,199 discloses a waste can having a dual function in which a lid is openable at both sides thereof like a seesaw or lifted upwardly by a foot lever. Moreover, the waste can includes an auxiliary can in which a disposable bag can be used.

However, the lid and the waste can are connected to each other by a lid frame, and the lid frame is connected with a foot lever, and the lid is detachably mounted on the lid frame by a rotatable hand-grip. Therefore, the waste can disclosed in Korean Patent No. 1,040,199 has a disadvantage in that it is complicated in structure and deteriorated in productivity.

OBJECT AND SUMMARY OF INVENTION

Accordingly, the present invention has been made in an effort to solve the above-mentioned problems occurring in the prior arts, and it is an object of the present invention to provide a multi-functional waste can having a dual function in which a lid of a garbage can is openable at both sides thereof like a seesaw or is openable while being lifted upwardly by a foot lever, and which has a rotating hinge to connect a main body, the lid and the foot lever into a single unit so that the lid can be used as a tool for compressing wastes, thus achieving a simple configuration in that the rotating hinge serves as a central shaft and as a lever for the lid. It is another object of the present invention to provide a multi-functional waste can in which an auxiliary can is detachably arranged in the waste can so that wastes with offensive odor can be sealed in a disposable bag.

To achieve the above objects, the present invention provides a multi-functional waste can having a dual function in which a lid of a garbage can is openable at both sides thereof like a seesaw or is openable while being lifted upwardly by a foot lever, wherein a rotating hinge is rotatably connected to an upper portion of the waste can and the foot lever is connected with the rotating hinge through a push rod, wherein the lid includes a pair of seesaw shafts arranged on an upper portion of the waste can so as to be openable from side to side, and wherein one of the seesaw shafts of the lid is collinearly connected with a central shaft of the rotating hinge, such that the lid is lifted upwardly while the rotating hinge is lifted upwardly when a user presses the foot lever.

The multi-functional waste can according to the preferred embodiments of the present invention includes a lid disposed at an upper portion of the waste can, and the lid is connected with the waste can through a rotating hinge. The lid includes a pair of seesaw shafts at both ends thereof, and the left side seesaw shaft is arranged on a bearing disposed at an upper portion of the waste can and the right side seesaw shaft is fit to a central shaft disposed at the rotating hinge. The central shaft of the rotating hinge and the bearing of the waste can are arranged collinearly, and hence, the lid is openable and closable at both sides based on the seesaw shafts like a seesaw.

Furthermore, because the rotating hinge is connected with a foot lever disposed at a lower portion of the waste can via a push rod in a state where the rotating hinge is connected to a hinge connection portion via a hinge pin, when a user presses the foot lever, the rotating hinge is lifted upwardly around the hinge pin, and in this instance, the lid connected with the central shaft of the rotating hinge is opened while levering the rotating hinge to be lifted upwardly. Finally, the lid serves a dual function in which the lid is openable at both sides thereof like a seesaw or is lifted up.

In the present invention, because the rotating hinge serves as the central shaft and the lever of the lid, the multi-functional waste can has several advantages in that it is simplified in structure and can be utilized as a tool to compress wastes of the waste can because the lid is separated from the rotating hinge in a state where the lid is lifted up. Additionally, the multi-functional waste can according to the preferred embodiment of the present invention can conveniently seal wastes with offensive odor because the waste can includes the auxiliary can disposed at one side thereof for putting a disposable bag into the auxiliary can.

DETAILED DESCRIPTION OF THE EMBODIMENTS

Figure 1:
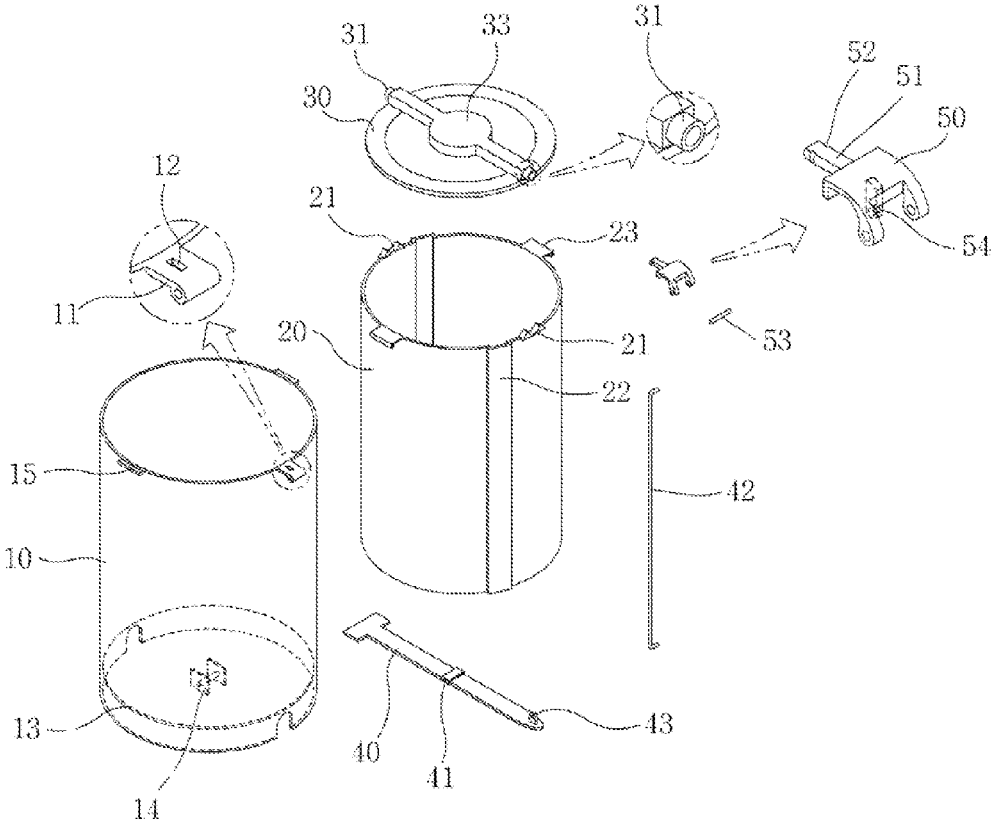
FIG. 1 is an exploded perspective view of a multi-functional waste can according to a first preferred embodiment of the present invention.
Figure 2:
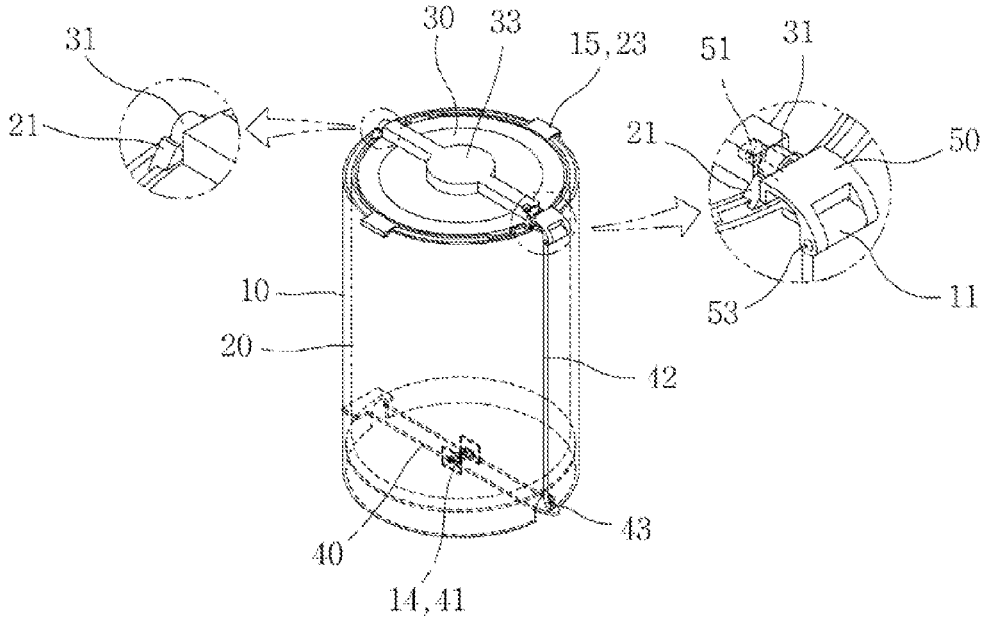
FIG. 2 is a perspective view showing assembly of the multi-functional waste can.
Figure 3:
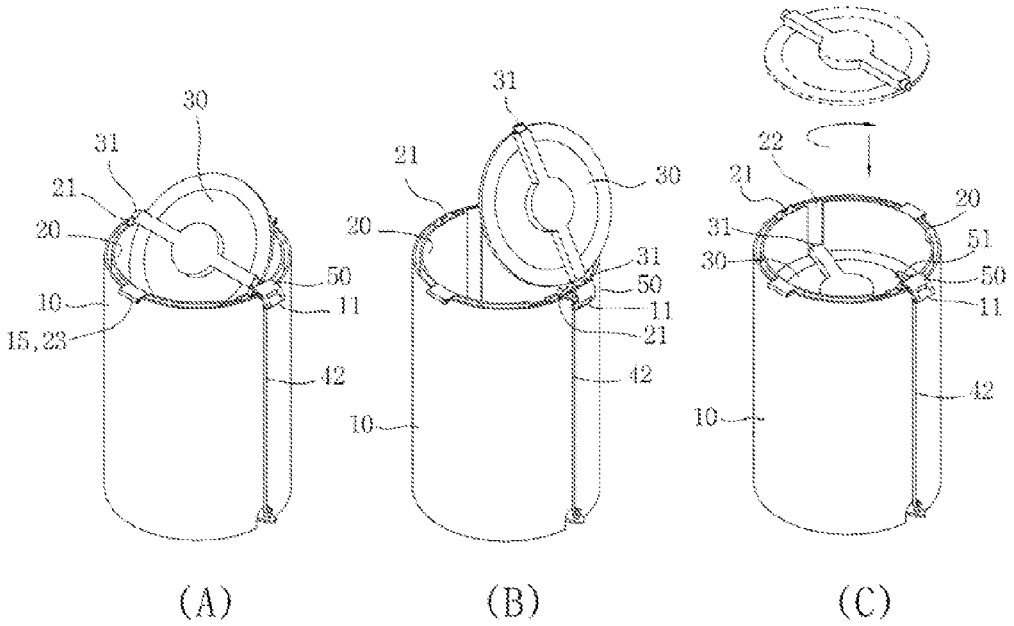
FIG. 3 is a perspective view showing a used state of the multi-functional waste can.
Figure 4:
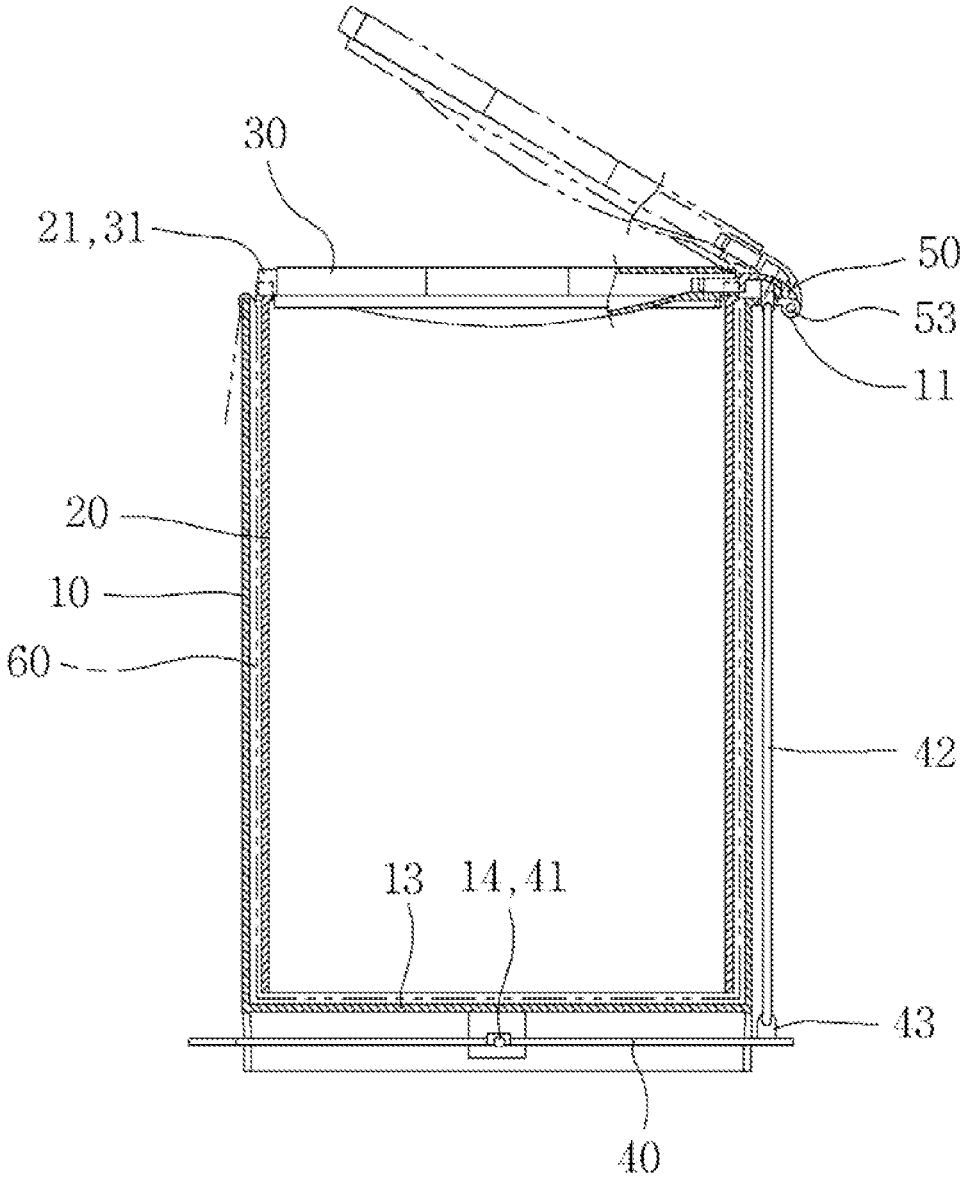
FIG. 4 is a sectional view showing assembly of the multi-functional waste can.
Figure 5:
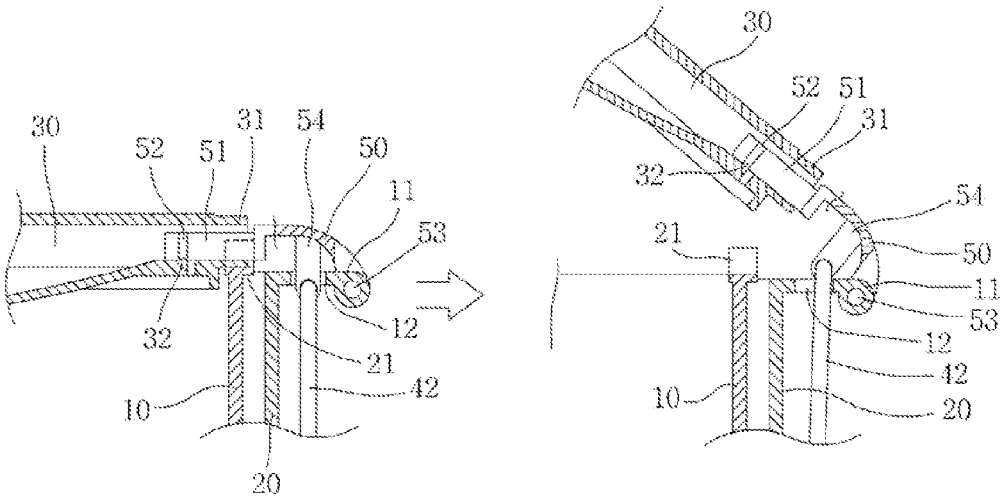
FIG. 5 is a partially enlarged sectional view of the multi-functional waste can.

As shown in FIGS. 1 to 5, a multi-functional waste can according to a first preferred embodiment of the present invention includes an inner case 20 and an outer case 10 which are in a cylindrical form. A volume-rate waste bag 60 is fit between the inner case 20 and the outer case 10, and in this instance, the inner case 20 is opened at the bottom so that a user can put wastes into the waste bag 60 and the outer case 10 is stopped at the bottom so as to support the waste bag 60. When fixing protrusions 23 disposed at both sides of the top of the inner case 20 are overlapped with and retained to fixing jaws 15 disposed at both sides of the top of the outer case 10, the inner and outer cases 20 and 10 are fixed together.

The inner case 20 has a lid 30 disposed at an upper portion thereof, and the lid 30 includes seesaw shafts 31. The inner case 20 includes: a pair of bearings 21 formed at both sides of the top thereof for supporting the seesaw shafts 31; and shaft elevation grooves 22 formed at both sides of the inner circumferential surface of the inner case 20 in a longitudinal direction, so that the seesaw shafts 31 are elevated along the shaft elevation grooves 22 when a user compresses wastes with the lid 30.

The outer case 10 has a foot lever 40 disposed at a lower portion thereof, and the lid 30 and the foot lever 40 are connected via a rotating hinge 50 hinge-connected to the outer case 10. The outer case 10 includes a bottom plate 13 disposed at the lower portion thereof and foot lever rings 14 disposed at the center of the bottom surface of the bottom plate 13, a retaining groove 41 formed at the center of the foot lever 40 is fit to the foot lever rings 14 so that the foot lever 40 is elevated.

The outer case 10 includes: a hinge connection portion 11 disposed at the upper portion thereof so that the rotating hinge 50 is rotatably connected via a hinge pin 53; and a passage 12 formed through the central portion of the hinge connection portion 11. Therefore, an upper end ring of a push rod 42 passes through the passage 12 and is caught to a connection portion 54 of the bottom surface of the rotating hinge 50, and a lower end ring of the push rod 42 is caught to a connection portion 43 of a front end of the foot lever 40, such that the foot lever 40 and the rotating hinge 50 are connected together via the push rod 42.

The rotating hinge 50 includes a central shaft 51 which is fit into the center of one of the seesaw shafts 31 of the lid 30. The central shaft 51, the seesaw shafts 31 and the bearings 21 are arranged collinearly, such that the central shaft 51 and the bearings 21 serve to guide rotation of the seesaw shafts 31 while the lid 30 rotates from side to side based on the seesaw shafts 31. Moreover, the central shaft 51 has a semicircular retaining slot 52 formed on the outer circumferential surface thereof, and the lid 30 has a retaining jaw 32 which are resiliently caught to the retaining slot 52. The unexplained reference numeral 33 designates a hand-grip which is used when the user utilizes the lid 30 to compress wastes.

As described above, in the first preferred embodiment of the present invention, the waste bag 60 is disposed between the inner case 20 and the outer case 10, and the lid 30 includes the seesaw shafts 31 which serves as the center of a seesaw and which is disposed at both sides thereof. The left side of the seesaw shafts 31 is arranged on the bearing 21 of the inner case 20, and the right side of the seesaw shaft 31 is fit to the central shaft 51 of the rotating hinge 50. In this instance, because the bearings 21 and the central shaft 51 are arranged collinearly, as shown in FIG. 3(A), the lid 30 is opened to both sides based on the seesaw shafts 31.

Additionally, the lid 30 can be easily separated because the seesaw shafts 31 are sectionally fit to the central shaft 51 of the rotating hinge 50. When the user grasps the hand-grip 33 and lifts the lid 30 slightly upwardly, because the rotating hinge 50 rotates on the hinge pin 53, the lid 30 can be easily lifted. In this state, when the user pulls the lid 30 in a direction that the lid 30 becomes estranged from the rotating hinge 50, the seesaw shafts 31 are released from the central shaft 51, and in this instance, the retaining jaw 32 is released from the retaining slot 52, such that the lid 30 is separated from the waste can. When the user put the lid 30 into the inner case 20 and presses the lid 30, the lid 30 can be utilized as a waste compressing tool as shown in FIG. 3(C). In this instance, the user adjusts the direction of the lid 30 so that the seesaw shafts 31 enter the shaft elevation grooves 22 formed in the inner case 20 without being caught to the inner circumferential surface of the inner case 20.

Moreover, if the compressed wastes are accumulated in the waste can, because the lid 30 is limited in the opening degree because the lid 30 is caught to the accumulated wastes while the lid 30 is opened like a seesaw, the lid 30 is not opened sufficiently. In this instance, when the user presses the foot lever 40, the push rod 42 is ascended along the passage 12 of the hinge connection portion 11. Because the top of the push rod 42 is connected with the connection portion 54 of the rotating hinge 50, the rotating hinge 50 is rotated around the hinge pin 53. In this instance, because the rotating hinge 50 and the lid 30 are combined together via the central shaft 51 and the seesaw shafts 31, the lid 30 is lifted upwardly as shown in FIG. 3(B), so that the user can continuously throw away more wastes into the waste can.

Figure 6:
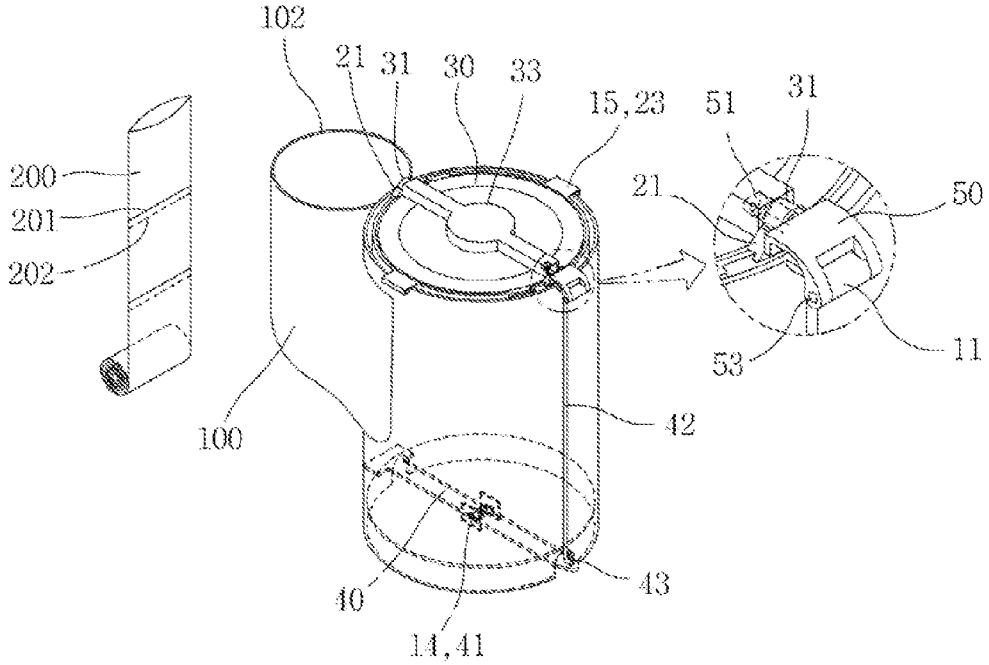
FIG. 6 is a perspective view showing a state where an auxiliary can is combined to the waste can.
Figure 7:
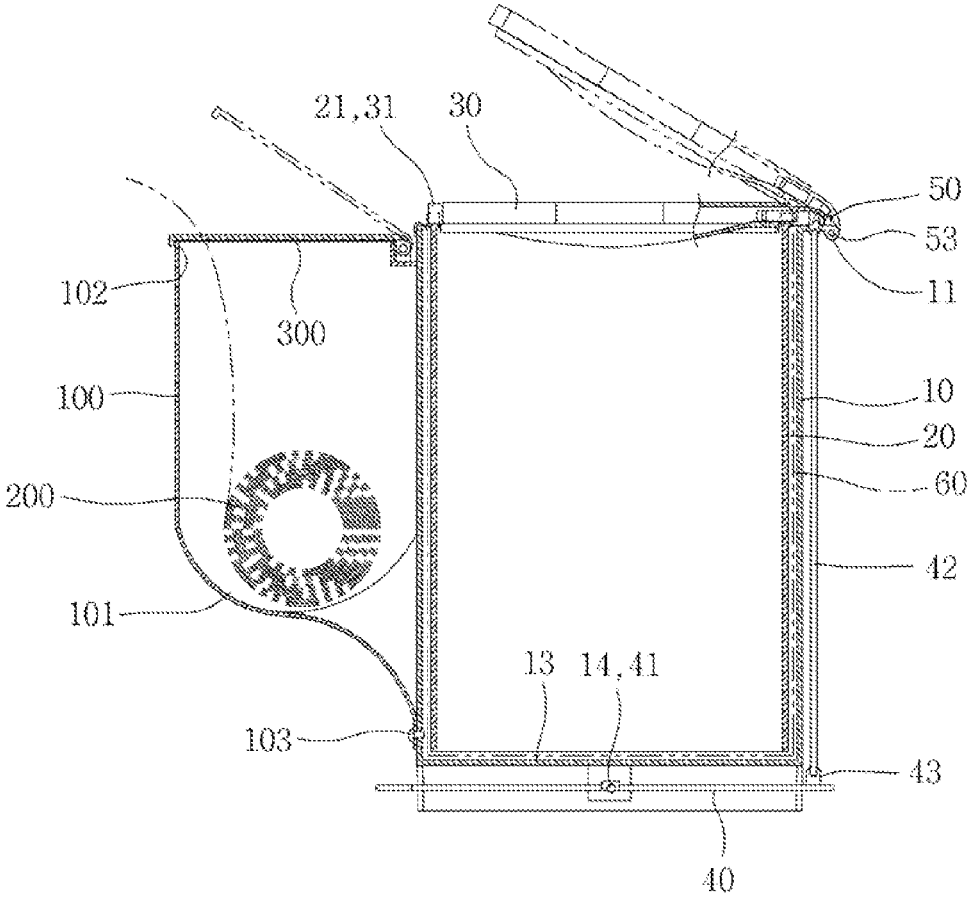
FIG. 7 is a sectional view showing a state where the auxiliary can is combined to the waste can.

FIGS. 6 and 7 illustrate an auxiliary can disposed on the waste can of the first preferred embodiment of the present invention. The auxiliary can 100 is detachably screw-coupled at one side of the outer case 10 via a screw nail 103. The auxiliary can 100 includes: an arc-shaped bag space 101 formed on the inner floor thereof such that a disposable bag 200 is put in; and a circular border 102 formed on the top thereof on which an opened entrance of the disposable bag 200 covers. An auxiliary lid 300 is covered on the border 102.

A plurality of the disposable bags 200 are continuously connected via perforated lines 202 and are safely kept in the auxiliary can 100 in a state where the disposable bags 200 are rolled, and a sealing line 201 is formed in front of each of the perforated line 202, such that a lower end of the disposable bag 200 is cut out in a sealed state.

As described above, in the first preferred embodiment of the present invention, the auxiliary can 100 contains the disposable bags 200 therein. Because the entrance of the disposable bag 200 is opened and covers the border 102 of the auxiliary can 100, the user can easily throw away general smelly wastes or polluted things such as diapers into the disposable bag 200. After that, when the wastes are accumulated, the entrance of the disposable bag 200 is removed from the border 102 and is tied up, and then, the used disposable bag 200 is torn off using the perforated line 202.

When the user pulls the disposable bag 200 in which the polluted wastes are contained and a new disposable bag 200 with two hands, the used disposable bag 200 is separated from the rolled new disposable bags 200. In this instance, because the used disposable bag 200 in which the polluted wastes are contained is completely sealed by the sealing line 201 formed at the lower end thereof, even though the used disposable bag 200 is put together with general wastes in the inner case 20, the used disposable bag 200 does not stink.

Additionally, when the user opens an entrance of the new disposable bag 200 and covers the opened entrance of the new disposable bag 200 on the border 102 of the auxiliary can 100, the auxiliary can 100 can be used continuously. The user can cover the auxiliary lid 300 on the auxiliary can 100 or use the auxiliary can 100 in an opened state.

Figure 8:
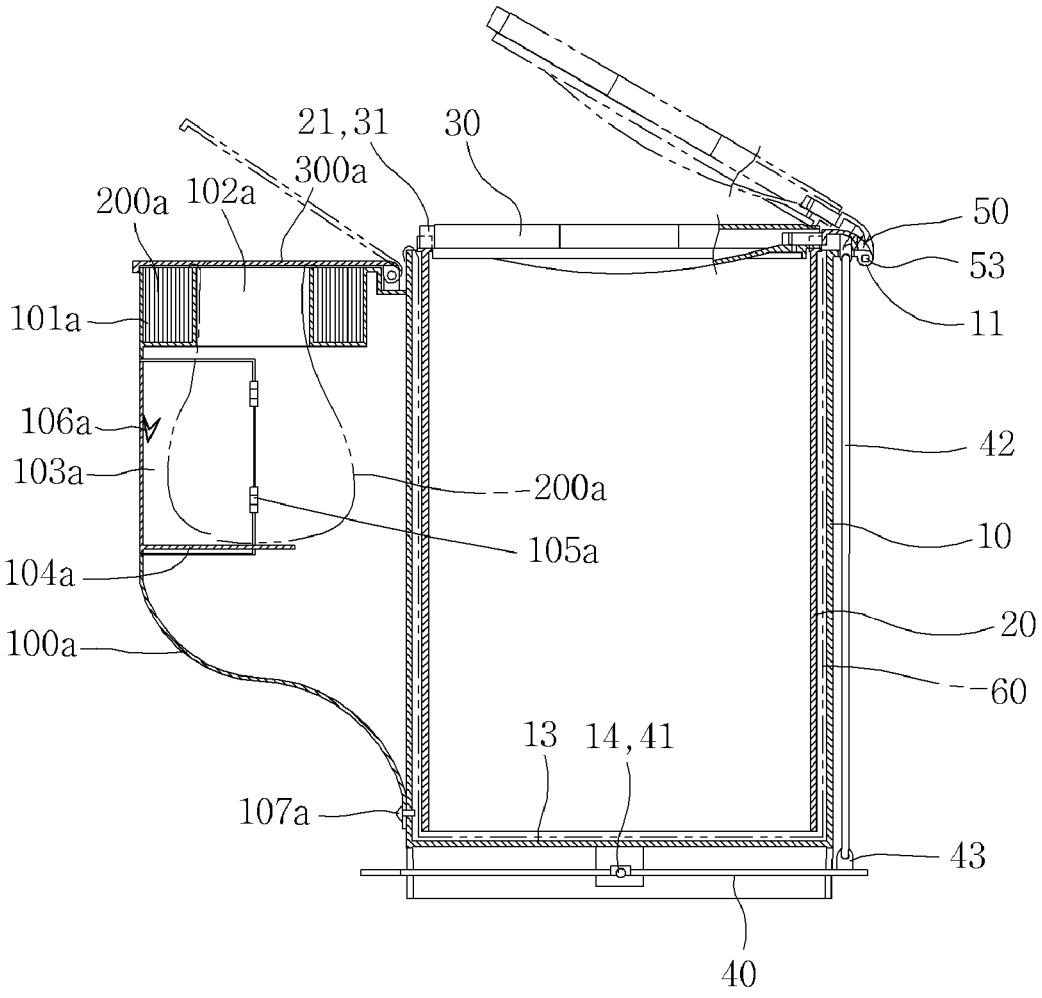
FIG. 8 is a sectional view showing a state where another auxiliary can is combined to the waste can.

FIG. 8 is a sectional view showing a state where another auxiliary can is combined to the waste can of the first preferred embodiment of the present invention. In FIG. 8, an auxiliary can 100*a* is detachably combined at one side of the outer case 10 via a screw nail 107*a*. The auxiliary can 100*a* includes: a ring-shaped bag space 101*a* disposed at an upper portion thereof; an inlet 102*a* communicating with the inside of the auxiliary can 100*a*; an auxiliary door 103 which is disposed at the front face thereof and connected to the inside of the auxiliary can 100*a* via a hinge 105*a* in such a way as to be openable and closable; and a bag supporting plate 104*a* disposed inside the auxiliary door 103*a* for supporting the bottom of the disposable bag 200*a*.

The disposable bag 200*a* is put on the bag space 101*a*, and in this instance, a plurality of the disposable bags 200*a* are folded in a zigzag form and arranged in a ring shape. When the disposable bags 200*a* are put on the bag space 101*a*, the user fit an end of the inside of the disposable bag 200*a* to the inlet 102*a* and pulls the disposable bag 200*a* to the inside of the auxiliary can 100*a*. In this instance, the disposable bag 200*a* is put on the bag space 101*a* and droops down to the inside of the auxiliary can 100*a* through the inlet 102*a*. The user ties up the opened end of the disposable bag 200*a*, then, can throw away polluted wastes into the disposable bag 200*a* through the inlet 102*a*.

The auxiliary can according to the first preferred embodiment of the present invention is used in a state where it is covered with the auxiliary lid 300*a*. Because the disposable bag 200*a* is fit to the inlet 102*a* and put into the auxiliary can 100*a* in the state where the disposable bags 200*a* are folded in the ring shape, the user can easily throw away smelly general wastes or polluted things, such as diapers, into the disposable bag 200*a*.

After that, the user pulls the used disposable bag 200*a* out of the auxiliary can 100*a* after opening the auxiliary door 104*a*, and then, cuts out the used disposable bag 200 in a necessary length using a cutter 106*a* mounted on the inner face of the auxiliary can 100*a* or any scissors. After that, the user ties up the entrance of the used disposable bag 200*a*, and then, put the used disposable bag 200*a* into the main can 10.

Next, the user can continuously use the auxiliary can 100*a* in a state where the disposable bag 200*a* is contained in the auxiliary can 100*a* when the user ties up an end of a new disposable bag 200*a* which is cut from the used disposable bag.

Figure 9:
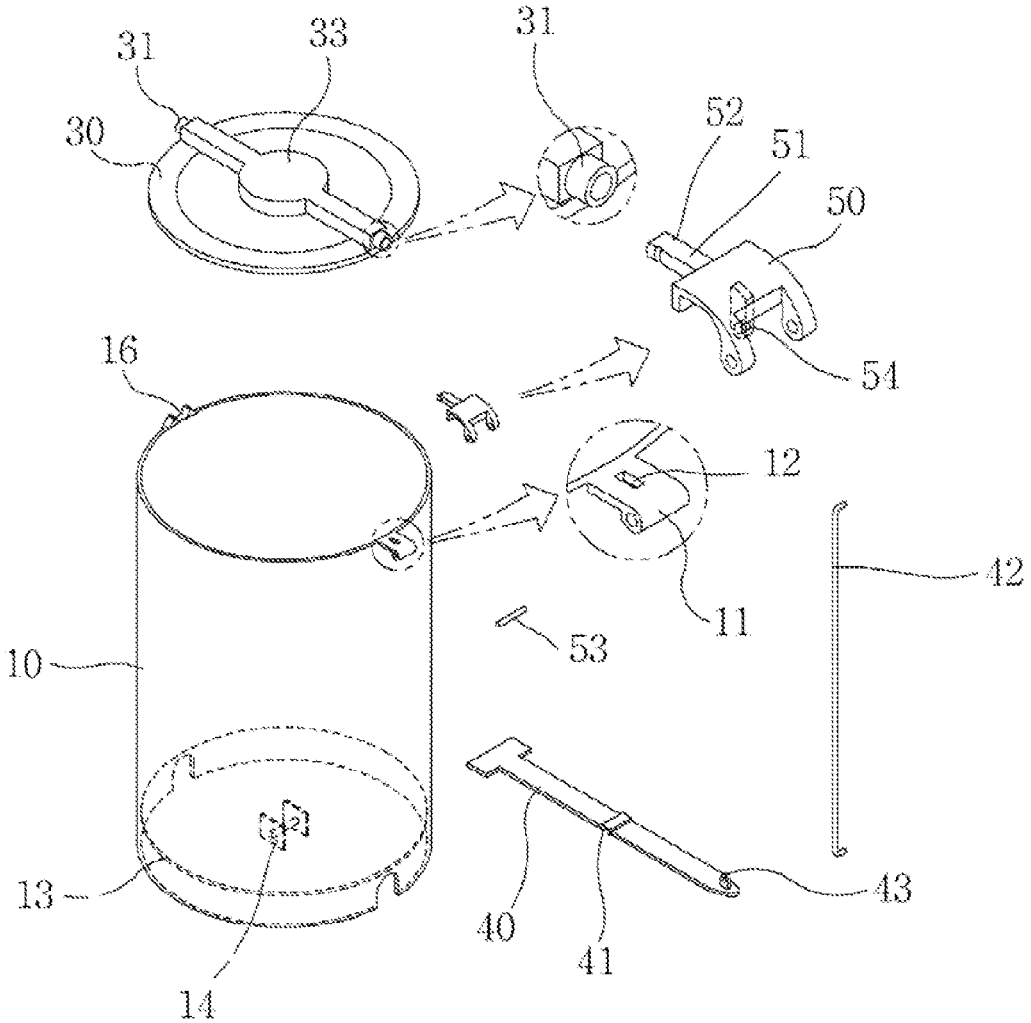
FIG. 9 is an exploded perspective view of a multi-functional waste can according to a second preferred embodiment of the present invention.
Figure 10:
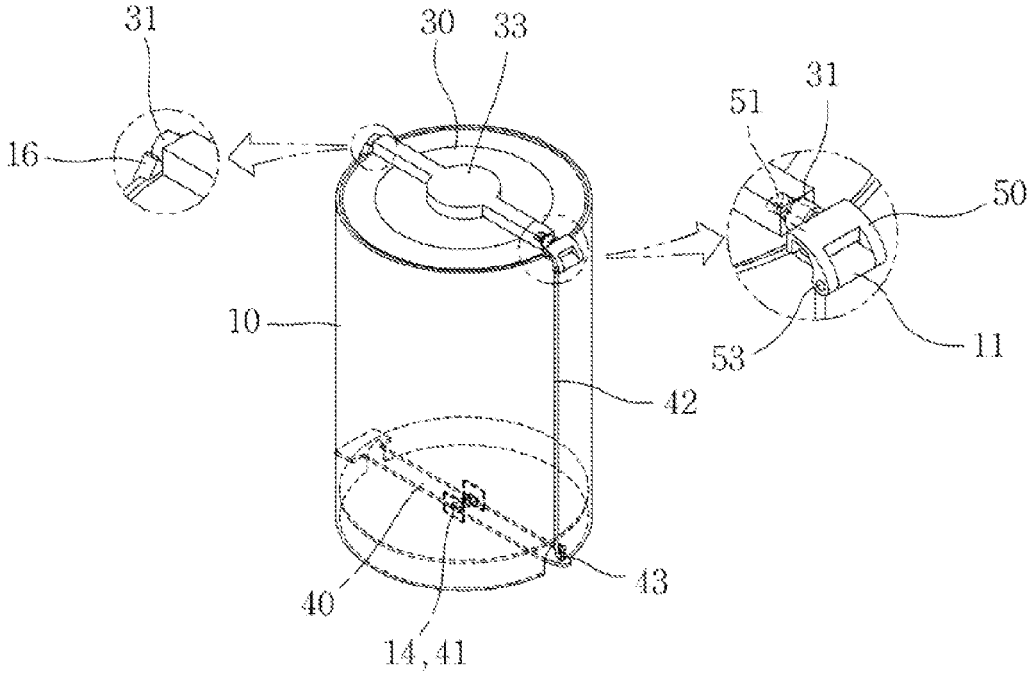
FIG. 10 is a perspective view showing assembly of the multi-functional waste can according to the second preferred embodiment of the present invention.
Figure 11:
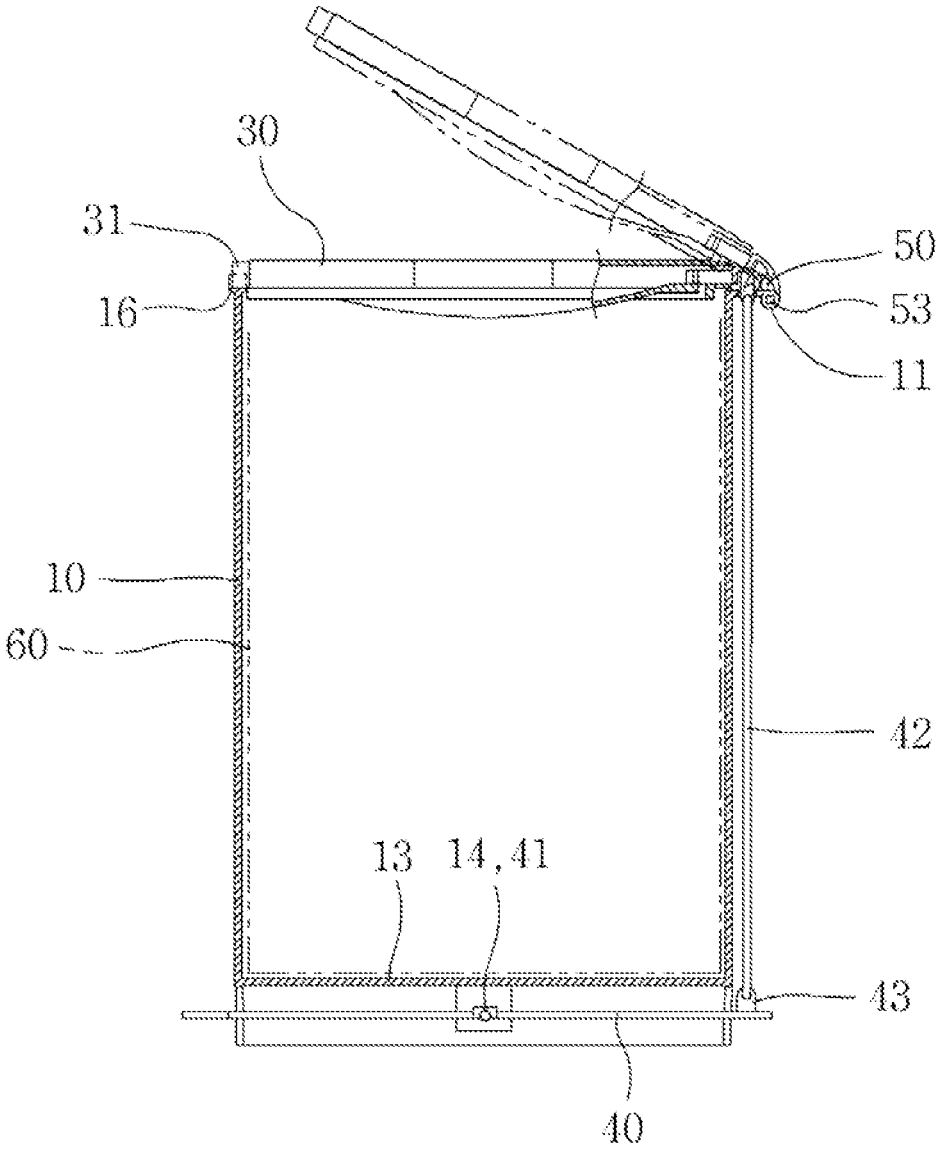
FIG. 11 is a perspective view showing a state where an auxiliary can is combined to the waste can according to the second preferred embodiment of the present invention.

FIGS. 9 to 11 illustrate a multi-functional waste can according to a second preferred embodiment of the present invention, and the multi-functional waste can according to the second preferred embodiment has the same structure as the multi-functional waste can according to the second preferred embodiment, but does not have the inner case of the first preferred embodiment. Therefore, the multi-functional waste can according to the second preferred embodiment is different from the multi-functional waste can according to the first preferred embodiment in that the bearing 16 for supporting the seesaw shaft 31 of the lid 30 is disposed at one side of the top of the outer case 10 and the fixing jaw formed at the top of the outer case 10 for fixing the inner case is omitted.

In the second preferred embodiment, one of the seesaw shafts 31 of the lid 30 is arranged on the bearing 16 of the top of the outer case 10 and the other one is fit to the central shaft 51 of the rotating hinge 50 but is not arranged on the top of the outer case 10. Because the bearing 16 and the central shaft 51 are arranged collinearly, they do not hinder that the lid 30 is rotated around the seesaw shafts 31 disposed at both sides so as to be opened and closed. When the user presses the foot lever 40, because the lid 30 connected with the central shaft 51 via the seesaw shafts 31 is lifted upwardly while the rotating hinge 50 is lifted upwardly by the push rod 42, like the first preferred embodiment, the lid 30 is opened from side to side like a seesaw or is lifted upwardly.

Figure 12:
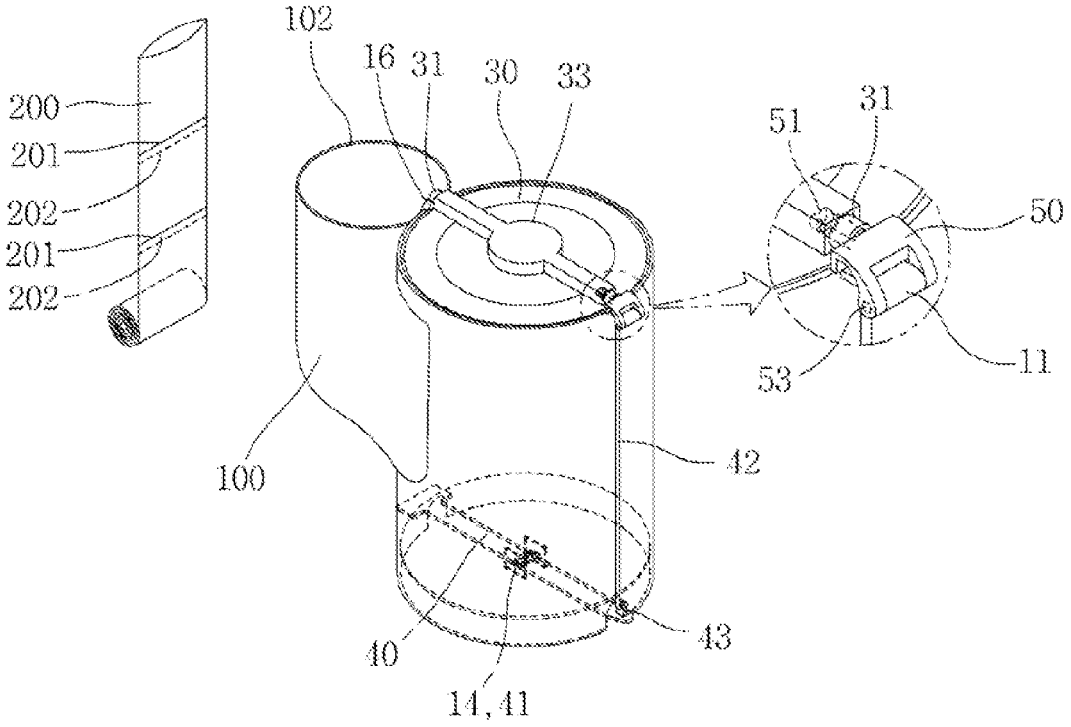
FIG. 12 is a sectional view showing a state where the auxiliary can is combined to the waste can according to the second preferred embodiment of the present invention.
Figure 13:
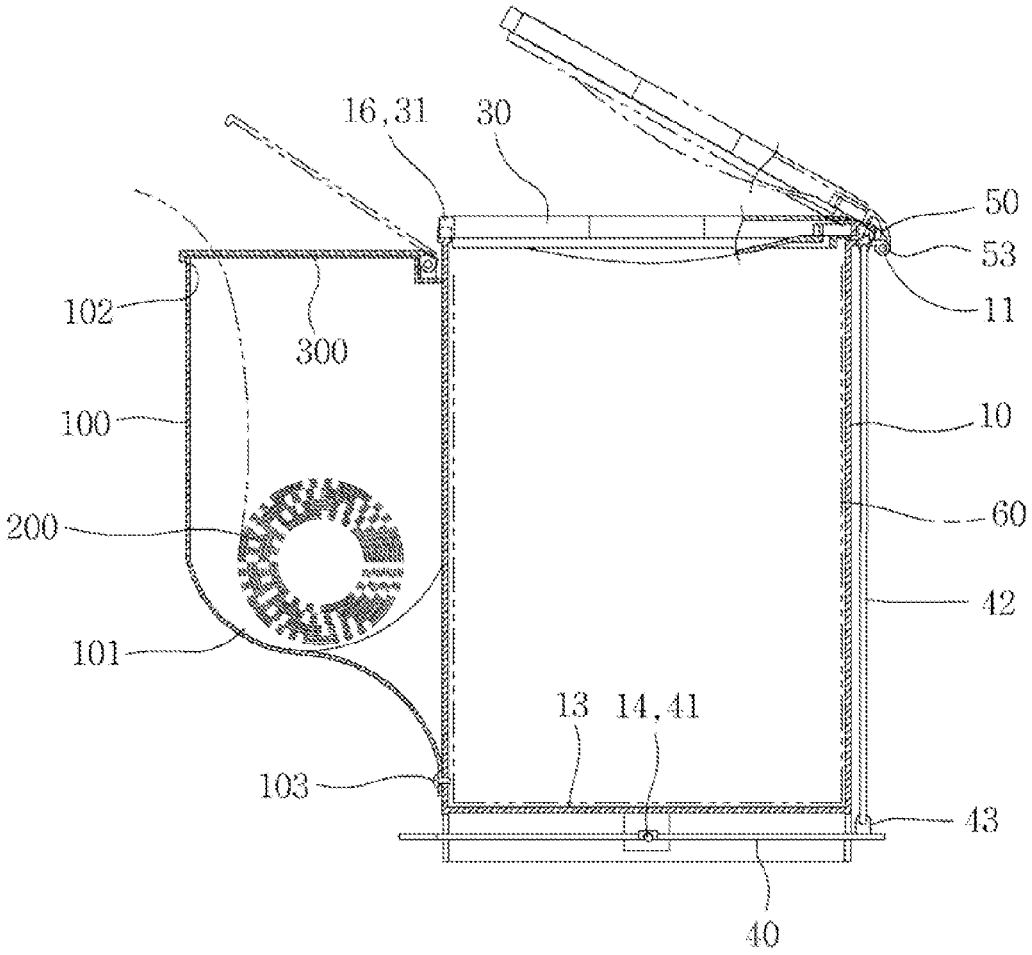
FIG. 13 is a sectional view showing a state where another auxiliary can is combined to the waste can according to the second preferred embodiment of the present invention.

FIGS. 12 and 13 illustrate a state where an auxiliary can is disposed on the waste can according to the second preferred embodiment of the present invention, and the auxiliary can has the same structure as the auxiliary can according to the first preferred embodiment.

Figure 14:
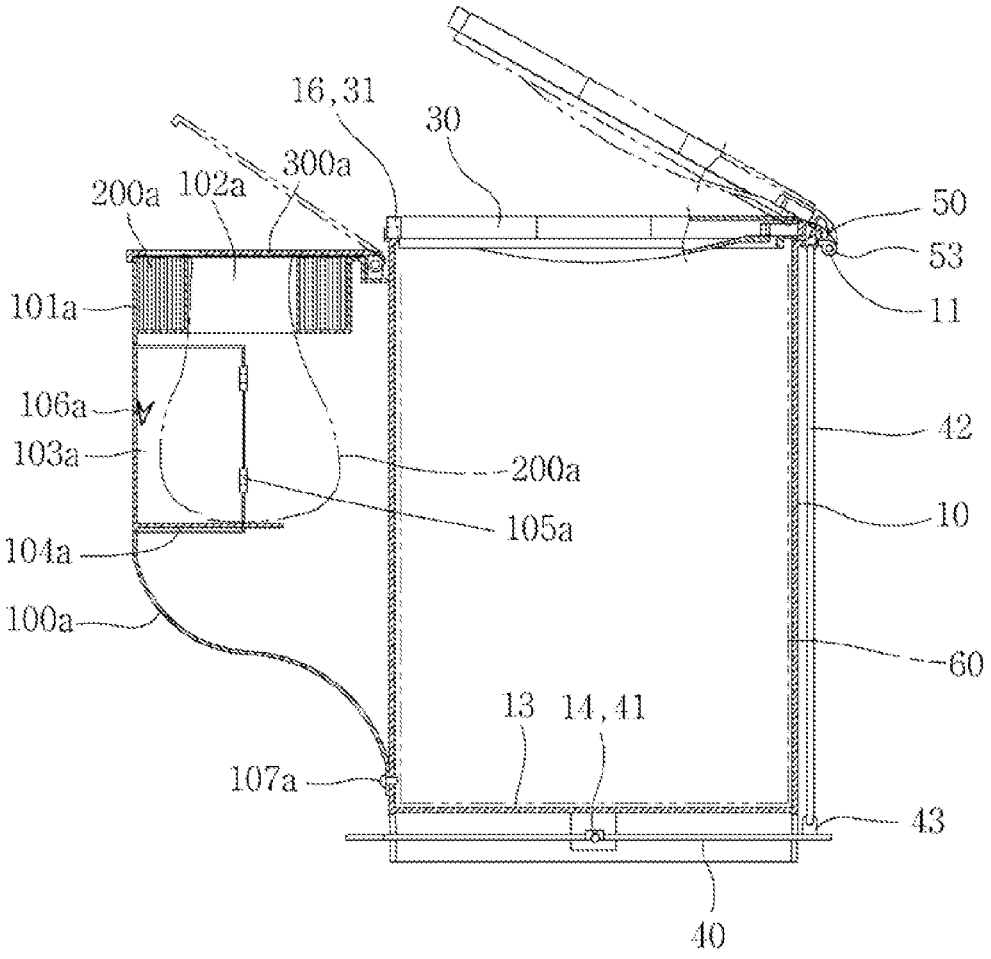
FIG. 14 is a sectional view showing a state where another auxiliary can is combined to the waste can according to the second preferred embodiment of the present invention.

FIG. 14 illustrates a state where another auxiliary can is disposed on the waste can according to the second preferred embodiment of the present invention, and the second auxiliary can has the same structure as the second auxiliary can according to the first preferred embodiment.

The invention claimed is:

1. A multi-functional waste can having a dual function in which a lid of a garbage can is openable at both sides thereof like a seesaw or is openable while being lifted upwardly by a foot lever;

wherein a rotating hinge is disposed at an upper portion of the waste can and lifted upwardly by being connected via a hinge pin, the foot lever being connected with the rotating hinge through a push rod;

wherein the lid includes a pair of seesaw shafts arranged on an upper portion of the waste can so as to be openable from side to side; and wherein one of the seesaw shafts of the lid is connected with a central shaft of the rotating hinge, such that the lid is lifted upwardly while the rotating hinge is lifted upwardly when a user presses the foot lever.

2. The multi-functional waste can according to claim 1, wherein the waste can comprises:

an outer case which is opened at an upper portion so that the lid is opened and closed;

bearings disposed at an upper portion of the outer case for supporting the seesaw shafts of the lid;

a hinge connection portion disposed at one side of the upper portion of the outer case for connecting the rotating hinge via a hinge pin; and a foot lever ring disposed at a lower portion of the outer case for rotatably connecting the foot lever.

3. The multi-functional waste can according to claim 1, wherein the waste can has a dual structure of an inner case and an outer case, a volume-rate disposable bag is arranged between the inner case and the outer case, a bearing is disposed at an upper portion of the inner case for supporting the seesaw shafts of the lid, a hinge connection portion is disposed at one side of the upper portion of the outer case for connecting the rotating hinge via a hinge pin, and a foot lever ring is disposed at a lower portion of the outer case for rotatably connecting the foot lever.

4. The multi-functional waste can according to claim 1, wherein the waste can includes an auxiliary can disposed on an outer circumferential surface thereof, and a disposable bag which is used to seal smelly wastes is contained in the auxiliary can.

5. The multi-functional waste can according to claim 4, wherein a plurality of disposable bags are put in the auxiliary can in a rolled form and are continuously connected via perforated lines, and has a sealing line formed in front of each perforated line, such that the lower end of the disposable bag is torn out into a piece in a sealed state.

6. The multi-functional waste can according to claim 2, wherein the outer case includes an auxiliary can disposed on an outer circumferential surface thereof, and a disposable bag which is used to seal smelly wastes is contained in the auxiliary can.

7. The multi-functional waste can according to claim 6, wherein a plurality of disposable bags are put in the auxiliary can in a rolled form and are continuously connected via perforated lines, and has a sealing line formed in front of each perforated line, such that the lower end of the disposable bag is torn out into a piece in a sealed state.

8. The multi-functional waste can according to claim 6, wherein the auxiliary can is detachably assembled to the outer circumferential surface of the outer case via a screw nail.

9. The multi-functional waste can according to claim 3, wherein the outer case includes an auxiliary can disposed on an outer circumferential surface thereof, and a disposable bag which is used to seal smelly wastes is contained in the auxiliary can.

* * * * *